US007049879B2

(12) United States Patent
Osamura et al.

(10) Patent No.: US 7,049,879 B2
(45) Date of Patent: May 23, 2006

(54) POWER SUPPLY CIRCUIT WITH CONTROL OF RISE CHARACTERISTICS OF OUTPUT VOLTAGE

(75) Inventors: Nobuyoshi Osamura, Nishio (JP); Takaharu Hutamura, Anjo (JP); Hiroyuki Ban, Aichi-ken (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/617,297

(22) Filed: Jul. 11, 2003

(65) Prior Publication Data

US 2004/0008079 A1 Jan. 15, 2004

(30) Foreign Application Priority Data

Jul. 12, 2002 (JP) ..... 2002-204371

(51) Int. Cl.
*H03K 17/56* (2006.01)

(52) U.S. Cl. ..... 327/419; 323/282; 363/50

(58) Field of Classification Search ..... 327/419, 327/427, 478, 432; 323/281–286, 238, 241, 323/321–323, 275; 363/49
See application file for complete search history.

(56) References Cited

U.S. PATENT DOCUMENTS

| | | | | |
|---|---|---|---|---|
| 5,045,771 | A * | 9/1991 | Kislovski | 323/282 |
| 5,257,156 | A * | 10/1993 | Kirkpatrick | 361/18 |
| 5,619,127 | A * | 4/1997 | Warizaya | 323/275 |
| 5,625,279 | A * | 4/1997 | Rice et al. | 323/283 |
| 5,670,894 | A | 9/1997 | Takaishi et al. | 326/27 |
| 5,698,973 | A * | 12/1997 | Goerke et al. | 323/238 |
| 5,883,504 | A | 3/1999 | Okada | 323/276 |
| 6,201,674 | B1 * | 3/2001 | Warita et al. | 361/18 |
| 6,525,517 | B1 | 2/2003 | Hojo et al. | 323/316 |
| 6,531,855 | B1 | 3/2003 | Miki et al. | 323/285 |
| 6,686,728 | B1 * | 2/2004 | Nakajima | 323/281 |
| 2002/0057079 | A1 | 5/2002 | Horie | 323/282 |

FOREIGN PATENT DOCUMENTS

| | | |
|---|---|---|
| JP | 54-82051 | 6/1979 |
| JP | 56-99521 | 8/1981 |
| JP | 3-123913 | 5/1991 |
| JP | 3-158911 | 7/1991 |
| JP | 5-62988 | 3/1993 |
| JP | 5-161348 | 6/1993 |
| JP | 8-46500 | 2/1996 |
| JP | 10-271680 | 10/1998 |
| JP | 11-119845 | 4/1999 |
| JP | 2001-84044 | 3/2001 |
| JP | 2002-14733 | 1/2002 |
| JP | 2002-149245 | 5/2002 |

* cited by examiner

*Primary Examiner*—Minh Nguyen
(74) *Attorney, Agent, or Firm*—Posz Law Group, PLC

(57) ABSTRACT

In a power supply circuit, a main transistor, which transmits power from an input terminal to an output terminal, is controlled so that a detected voltage from an input voltage is consistent with a reference voltage indicating a target voltage. An output current is detected and a limited value of the output current is set so that the limited value increases gradually when the output voltage rises up to the target voltage. The main transistor is controlled so that the output current keeps a value less than or equal to the limited value. This configuration is able to suppress an overshoot of the output voltage, thanks to a gradually raised control of the limited value. Additionally, to avoid the influence of a ringing component of the input voltage, a delay control circuit to give a delay to the start of rise of the output voltage can be provided.

27 Claims, 14 Drawing Sheets

LIMITED CURRENT 100mA

LIMITED CURRENT 200mA

LIMITED CURRENT 400mA

LIMITED CURRENT 700mA

LIMITED CURRENT 1A

LIMITED CURRENT 1.4A

POWER SUPPLY CIRCUIT WITH CONTROL OF RISE CHARACTERISTICS OF OUTPUT VOLTAGE

BACKGROUND OF THE INVENTION

1. The Field of the Invention

The present invention relates to a power supply circuit capable of actively controlling rise characteristics of an output voltage to be supplied to an electrical load connected to the power supply circuit.

2. Related Art

Power supply circuits, which are required by almost all electronic apparatuses, can be categorized into many types, one of which is a series-regulator type of power supply circuit.

FIG. 1 exemplifies the electronic configuration of such a series-regulator type of power supply circuit 1, which has been used conventionally. This power supply circuit 1 has an input terminal 2 and an output terminal 3, between which a resistor R1 and a transistor Q1 are inserted in series. The transistor Q1 is placed to be controlled by an IC 4. A capacitor C1 is arranged between the input terminal 2 and a ground line 5 for smoothing input voltage, while another capacitor C2 for smoothing output voltage and a resistor R2 (which is a representative of resistive loads) are arranged between the output terminal 3 and the ground line 5.

The IC 4 is in charge of not only constant-voltage control for the transistor Q1 so that a voltage Vo at the output terminal 3 is made to be equal to a target voltage (for example, 5 volts) but also current limiting control to prevent an excessive output current Io. Resistors R3 and R4, which belong to the IC 4 to be connected to the output terminal 3, divide the output voltage Vo to detect a voltage Va. An operational amplifier 6, which is also incorporated in the IC 4, amplifies a difference voltage between the detected voltage Va and a reference voltage Vr indicating a target voltage. The IC 4 also includes transistors Q2 and Q3. One transistor Q2 uses an output voltage from the operational amplifier 6 to drive the transistor Q1. The other transistor Q3, which is electrically connected to a base of the transistor Q2 and the ground line 5, receives control from a current limiter 7 placed in the IC 4. That is, the current limiter 7 drives the transistor Q3 to prevent a voltage across the resistor R1 from exceeding a predetermined limit.

The above power supply circuit 1 is, as one application, applied to an ECU (Electronic Control Unit) mounted to vehicles such as automobiles. In such a case, applying a battery voltage to the input terminal 2 of the power supply circuit 1 will cause the output voltage Vo to rise sharply from a level of zero volts (i.e., causing an overshoot). This overshoot becomes large as a rate of rise of the output voltage Vo becomes fast (i.e., as a rise time becomes shortened). The rise time Tr of the output voltage Vo can be expressed as follows:

$$Tr=C*Vo/Ic \quad (1),$$

wherein C is a capacitance of capacitive loads (including a capacitor C2) connected to the output terminal 3 and Ic is a charge current flowing into the capacitive loads.

This expression (1) shows that the rise time Tr of the output voltage Vo becomes shorter as the capacitance of the capacitive loads becomes smaller and/or the charge current Ic becomes larger, thus causing an increase in the overshoot.

The above power supply circuit 1 includes the current limiting circuit 7 in order to remove such a problem.

Practically, when the current limiting circuit 7 operates to have a smaller current limit, the charge current Ic can be made smaller in amount. However, because it is impossible to lower the current limit than a supply current to the load (resistor R2) during the operation at a rated voltage output, the charge current Ic cannot be set to a lower level if a larger load current is required. Hence, the conventional technique has been obliged to take a countermeasure of, instead of lowering the current limit, giving a larger capacitance to the capacitor C2 such that the overshoot can be suppressed.

This strategy encounters another problem. Specifically, when increasing the capacitance of the capacitor C2 (thus increasing a load capacitance), the capacitor C2 becomes large in the size, leading to an increase in the area of a substrate on which various electrical components are mounted. Therefore, it has been against the demand that a mounting space should be saved and manufacturing cost should be reduced.

SUMMARY OF THE INVENTION

A first object of the present invention is to provide, with due consideration to the drawbacks of the above conventional configuration, a power supply circuit capable of controlling a rise rate of the output voltage with steadiness, thereby obtaining an improved rise characteristic of the output voltage.

A second practical object of the present invention is to provide a power supply circuit capable of controlling a rise rate of the output voltage with steadiness, thereby suppressing an overshoot of the output voltage, on condition that the capacitance of a capacitor connected to an output terminal is kept to a lower amount.

A third practical object of the present invention is to provide a power supply circuit capable of controlling a rise rate of the output voltage with steadiness, thereby avoiding the influence of a ringing phenomenon on the output voltage that is raised.

In order to accomplish the above first and second objects, the present invention provides a power supply circuit comprising: a main transistor placed in a power transmission path connecting an input terminal and an output terminal; a voltage detecting circuit configured to detect a detected voltage in response to an output voltage supplied through the output terminal; a reference-voltage producing circuit configured to producing a reference voltage in accordance with a target voltage; a voltage control circuit configured to control the main transistor so that the detected voltage is consistent with the reference voltage; a current detecting circuit configured to detect an output current supplied through the output terminal; a limited-current-value setting circuit configured to set a limited value of the output current so that the limited value increases gradually in cases where the output voltage is made to rise up to the target voltage; and a current limiting circuit configured to control the main transistor so that the output current keeps a value less than or equal to the limited value in cases where the output voltage is made to rise up to the target voltage.

In this configuration, the voltage control circuit controls the main transistor such that a detected voltage from the output voltage is consistent with the reference voltage (target voltage), so that the output voltage is made to be equal to the target voltage (i.e., voltage tracking control), except for a startup operation for the power supply. Thus, when the target voltage is constant, the voltage tracking control is carried out as constant-voltage control. Meanwhile, the current limiting circuit controls the main transistor so that the output current does not exceed the limited value. Hence it is possible to prevent the output current to exceed the limited value even when there is an overload (i.e. current limiting control). The current limiting control has priority over the voltage tracking control.

Furthermore, the limited-current-value setting circuit gradually increases a limited value of the output current, in cases where the output voltage rises up to a target voltage (namely, when the voltage tracking control is started, a voltage is applied to the input terminal under the voltage tracking control, or others). Hence, it is possible that, thanks to operations of the current-limiting circuit, the output current is kept to an amount below the limited value, while the output current is gradually raised in response to an increase in the limited value. Responsively to this, the output voltage also increases little by little.

Accordingly, with reducing the capacitance of a capacitor connected to the output terminal, an overshoot of the output voltage can be suppressed. The capacitor can made compact in size, so that the power supply circuit can be made small and manufacturing cost thereof become low. In a steady sate after a rise of the output voltage, the limited-current-value setting circuit sets the limited amount of the output current to a current amount required by a load connected by the power supply circuit, thus making it sure that the voltage tracking control is carried out normally.

It is preferred that the limited-current-value setting circuit is configured to stepwise increase the limited value with an elapse in time during a rise of the output voltage. For instance, the limited-current-value setting circuit is configured to stepwise increase the limited value by a predetermined amount at given intervals of time during the rise of the output voltage. It is also possible that the limited-current-value setting circuit is provided with a timer circuit counting a predetermined period of time and a limited-value increasing circuit increasing the limited value by the predetermined amount when the timer circuit finishes counting the predetermined period of time.

Preferably, the limited-current-value setting circuit is configured to continuously increase the limited value with an elapse in time during a rise of the output voltage. This makes it possible to increase the output voltage continuously, whereby an overshoot can be suppressed more steadily.

In order to achieve the first to third objects, the present invention provides the power supply circuit according to the foregoing basic configuration, further comprising a delay control circuit configured to output a rise start signal at a time when a ringing component of an input voltage that has been applied to the input terminal is reduced, wherein the limited-current-value setting circuit is configured to set the limited value of the output current so that the limited value increases gradually, in response to the outputted rise start signal; and the current control circuit configured to control the main transistor so that the output current keeps the limited value, on the basis of the output current detected by the current detecting circuit and the limited value set by the limited-current-value setting circuit.

In this configuration, in particular, the limited-current-value setting circuit increases the limited value of the output current gradually when a ringing component on the applied input voltage is reduced. Hence, in making the output voltage increase in response to an increase in the limed value, voltage fluctuations appearing in the output voltage due to the ringing component of the input voltage can be lowered remarkably. This power supply circuit is able to supply power to a load circuit configured to be reset using the output voltage obtained during its rise operation.

It is preferred that the time when the delay control circuit outputs the rise start signal is designated as a time when a predetermined period of time elapses after the application of the input voltage to the input terminal.

It is also preferred that the delay control circuit is provided with a charge circuit operating with the input voltage applied and providing a charge voltage on the input voltage and a comparison circuit drawing a comparison between the charge voltage and a given threshold so as to output the rise start signal.

Preferably, the delay control circuit is provided with an oscillation circuit outputting a reference clock signal and a timer circuit operating using the reference clock signal to output the rise start signal when the predetermined period of time elapses after the application of the input voltage to the input terminal.

Still preferably, the delay control circuit is provided with a comparison circuit drawing a comparison between the applied input voltage and a given threshold so as to output a comparison signal and a constant-level detecting circuit outputting the rise start signal on condition that the comparison signal is kept at the same level for a given interval of time.

It is preferred that, the power supply circuit further comprises a shutoff circuit configured to control the main transistor in an off-state thereof until the rise start signal is outputted.

For instance, each of the foregoing various-mode power supply circuits is formed into a series regulator having circuitry in which a current supply path serving as the power transmission path is placed to connect both of the input terminal and the output terminal, the main transistor being placed in the current supply path.

DETAILED DESCRIPTION OF THE PREFERRED EMBODIMENTS

Referring to FIGS. 2 to 6, a first embodiment of the present invention will now be described.

(First Embodiment)

Figure 1:
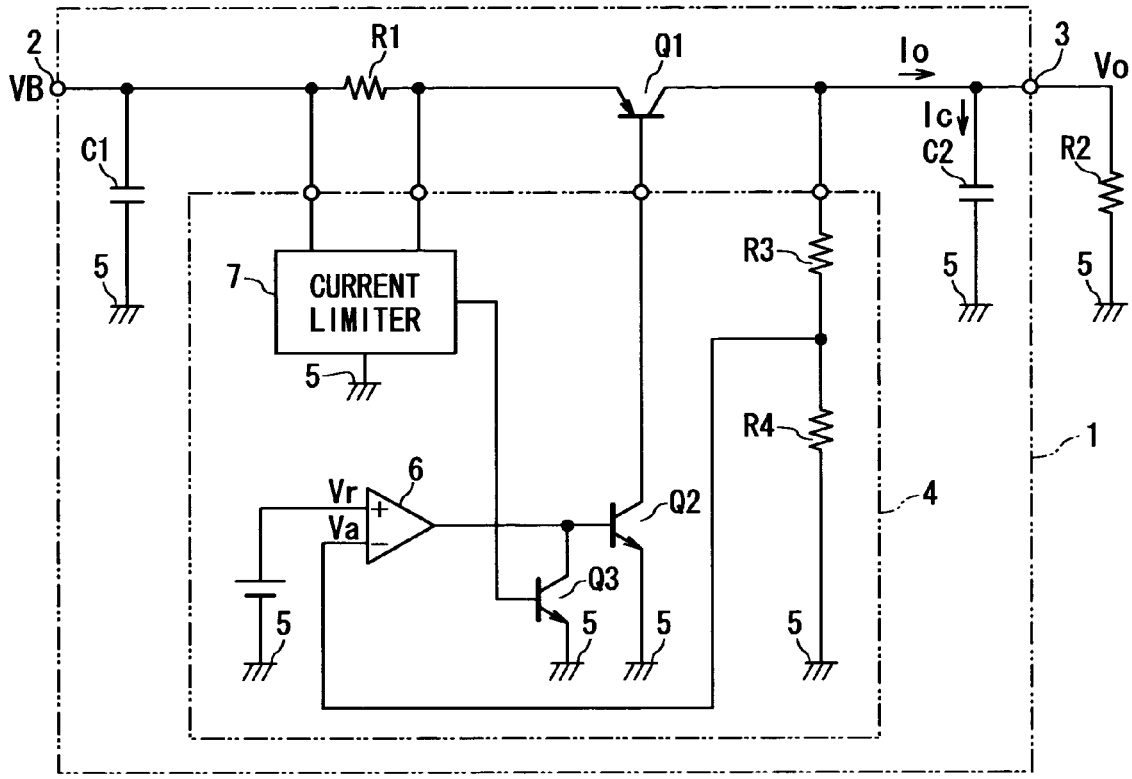
FIG. 1 PRIOR ART
FIG. 1 shows the electrical configuration of one example of a conventional power supply circuit.
Figure 2:
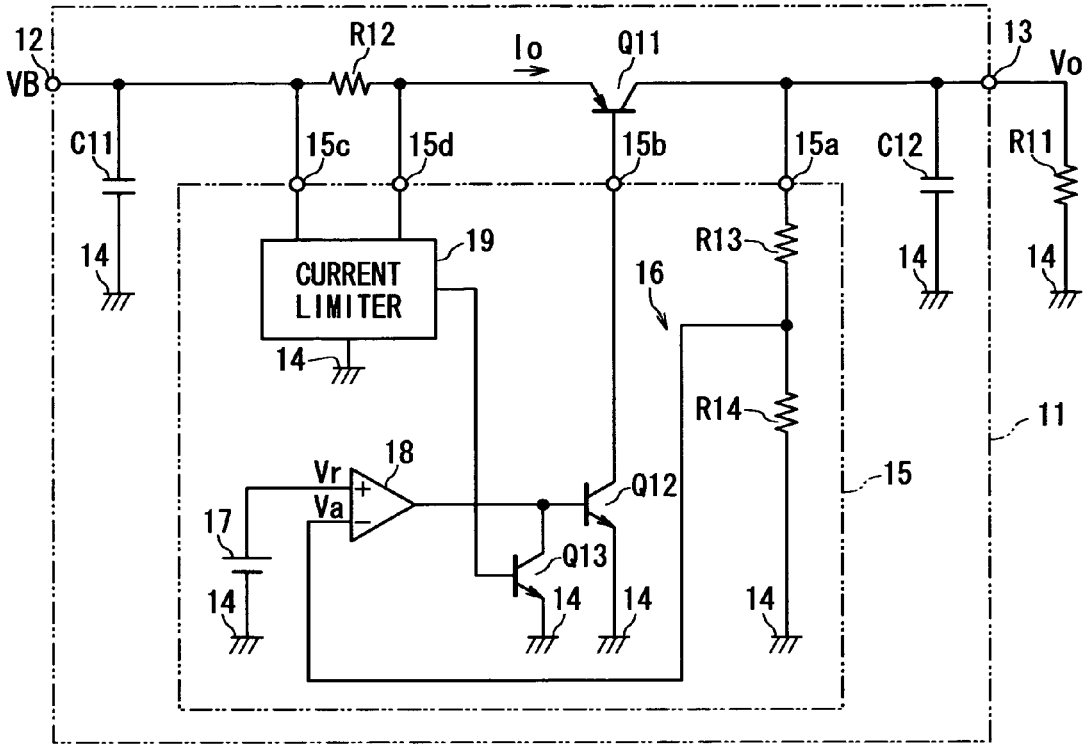
FIG. 2 shows the electrical configuration of a power supply circuit according to a first embedment of the present invention.

FIG. 2 shows, partly in block form, the electrical circuitry of a series-regulator type of power supply circuit 11 according to a first embodiment of the present invention. This power supply circuit 11, which is used by, for example, a power supply apparatus mounted to an ECU (Electrical Control Unit) for use in vehicles, is configured to have one substrate on which the entire circuitry is mounted.

The power supply circuit 11 has not only an input terminal 12 to which a battery voltage VB (for instance, 14 volts) is supplied from an on-vehicle battery (not shown in FIG. 2) but also an output terminal 13 from which an output voltage Vo (for instance, 5 volts) is provided to loads including control IC incorporates into other circuits. Such loads are mounted on the same substrate as that for the power supply circuit 11 and representatively shown by a resistor R11 in FIG. 2.

Between the input terminal 12 and the output terminal 13, there is formed a current supply path (serving as a power transmission path). In this current supply path, a series circuit consisting of a resistor R12 (corresponding to a current detecting circuit) and a PNP-type transistor Q11 (corresponding to a main transistor) is inserted so as to connect both an emitter and collector of the transistor Q11 to both the resistor R12 and the output terminal 13, respectively. The power supply circuit 11 is also provided with capacitors C11 and C12. Both ends of one capacitor C11, which smoothens an input voltage, is connected respectively to the input terminal 12 and a ground line 14, while both ends of the other capacitor C12, which smoothens an output voltage, is connected respectively to the output terminal 13 and the ground line 14. The capacitor C12 is formed of, for example, a chip type of tantalum electrolytic capacitor of a capacitance 3.3 μF.

The transistor Q11 is placed in the circuitry so as to be controlled by an IC 15 manufactured under a bipolar process. This IC 15 has a voltage detecting circuit 16, reference voltage generating circuit 17 (forming a reference voltage producing circuit), operational amplifier 18 (forming a voltage control circuit), current limiter 19, transistors Q12 and Q13, and resistors R13 and R14.

The IC 15 will now be detailed. Between an IC terminal 15*a* electrically connected to the output terminal 13 and the ground line 14, the voltage detecting circuit 16 composed of the voltage-dividing resistors R13 and R14 mutually connected in series is arranged. A common connection point through which both the resistors R13 and R14 are connected to each other will thus generate a detection voltage Va made by dividing the output voltage Vo by a ratio of resistance values of both the resistors.

The reference voltage generating circuit 17 is formed into, by way of example, a band-gap reference voltage circuit and generates a given reference voltage Vr corresponding to a target voltage (in this embodiment, 5 volts). The reference voltage Vr and detected voltage Va are fed to non-inverting and inverting input terminals of the operational amplifier 18, respectively.

Between an IC terminal 15*b* electrically connected with a base of the transistor Q11 and the ground line 14, there is provided the NPN-type transistor Q12 so as to connect its collector and emitter to both the IC terminal 15*b* and the ground line 14, respectively. A base of the transistor Q12 is electrically coupled with an output terminal of the operational amplifier 18 is also routed to the ground line 14 via a collector and an emitter of the NPN-type transistor Q13. A base of the transistor Q13 is coupled with an output terminal of the current limiter 19.

The current limiter 19 is responsible for limited current passing through the resistor R12 and serves as a current limit setting circuit and a current limiting circuit according to the present invention. This current limiter 19 operates to respond to the battery voltage VB coming through an IC terminal 15*c* and receives a voltage across the resistor R12 via both of the IC terminal 15*c* and another IC terminal 15*d* in order to control the operation of the transistor Q13. Current that passes the resistor R12 is equal in amount to currents fed to both the capacitor C12 and the resistor R11, that is, an output current Io.

Figure 3:
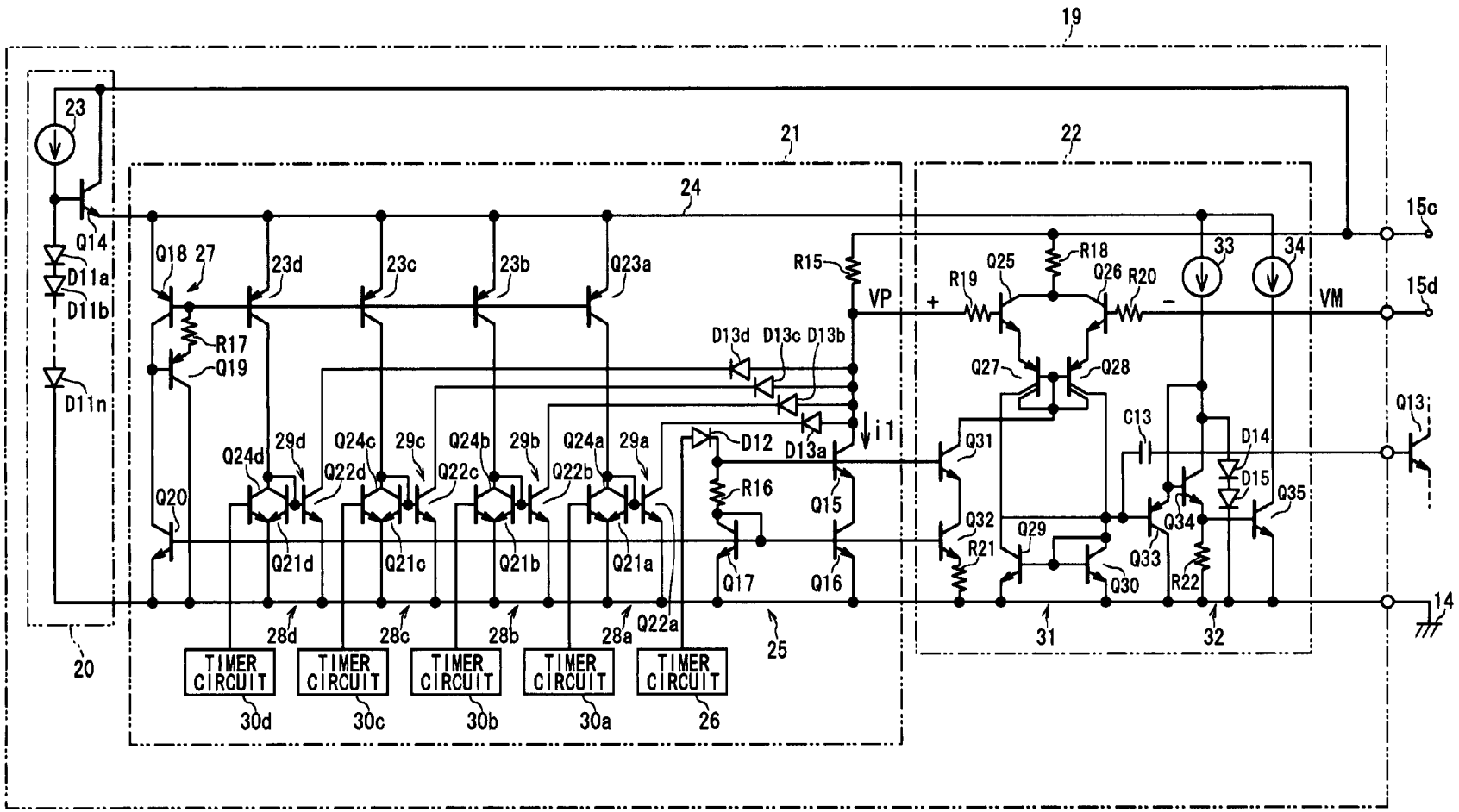
FIG. 3 is a circuit diagram showing the electrical configuration of a current limiter employed by the power supply circuit in the first embodiment.

FIG. 3 details a more practical configuration of the current limiter 19. The current limiter 19 is composed of a constant-voltage circuit 20, limited-current-value setting circuit 21, and operational amplifier 22 (composing the current limiting circuit of the present invention).

Of these components, the constant-voltage circuit 20 is provided with a current-constant circuit 23 and diodes D11*a*, D11*b*, . . . , D11*n*, which are inserted in series between the IC terminal 15*c* and the ground line 14, and a transistor Q14 connected to both the IC terminal 15*c* and a power line 24. The constant-voltage circuit 20 operates using, as a reference voltage, an anode potential of the diode D11*a*, with the result that this circuit 20 provides a constant voltage with the power line 24.

Further, the limited-current-value setting circuit 21 will produce a reference voltage that corresponds to a limit value to the output current Io, between the terminals across a resistor R15 connected to both the IC terminal 15*c* and the non-inverting input terminal of the operational amplifier 22. In the limited-current-value setting circuit 21, NPN-type transistors Q15 and Q16 connected in series to each other are provided between the IC terminal 15*c* and the ground line 14 so as to achieve a serial circuit to the resistors R15. A current i1 flowing those transistor Q15 and Q16 is determined by a bias circuit 25. The bias circuit 25 is composed by a constant-voltage generating circuit 26, and a diode D12, resistor R16, and a transistor Q17 inserted in series between the circuit 26 and the ground line 14.

Still further, the limited-current-value setting circuit 21 is provided with a constant-current circuit 27 composed of transistors Q18, Q19 and Q20 and a resistor R17, which is inserted between the power line 24 and the ground line 14. A base of the transistor Q20 connected to the ground line 14 is electrically coupled in common to bases of the forgoing transistors Q16 and Q17.

In addition, the limited-current-value setting circuit 21 is provided with four reference-current generating circuits 28*a* to 28*d*, each of which has the same circuit configuration in which a constant-current circuit and a timer circuit is combined with each other. One of the reference-current generating circuits, 28*a*, will be detailed representatively. A current-mirror circuit 29*a*, which consists of NPN-type transistors Q21 and Q22, is coupled with the ground line 14. A collector of the input-side transistor Q21 a is routed to the power line 24 by way of a collector and an emitter of a PNP-type transistor Q23*a* biased by the constant-current circuit 27. To the transistor Q21 is in parallel connected an NPN-type transistor Q24*a*, of which base is connected with a timer circuit 30*a* for control. On the other hand, a collector of the transistor Q22 is coupled with a non-inverting input terminal of the operational amplifier 22 via a diode 13*a*. In this reference-current generating circuit 28*a*, the circuitry other than the timer circuit 30*a* composes a limit-value increasing circuit.

Each of the timer circuits 30*a* to 30*d* starts to count a time t1 (t2, t3 or t4) at the start of a rise operation of the output voltage Vo. Before completion of each counting operation, each of the timer circuits 30*a* to 30*d* outputs a voltage of which level (High level) is sufficient to turn on each transistor Q24*a* (to 24*d*). And, on completion of each counting operation, each of the timer circuits 30*a* to 30*d* outputs a voltage of which level (Low level) is sufficient to turn off each transistor Q24*a* (to 24*d*).

Then, the operational amplifier 22 will be detailed in its configuration and operation.

The non-inverting and inverting input terminals of the operational amplifier 22 will receive both a reference voltage corresponding to a current limit value and a voltage across the resistor R12 (which is caused by an output current Io through the resistor R12), respectively, which take, as a reference potential, a potential (battery voltage VB) at the IC terminal 15*c*.

The operational amplifier 22 has a differential amplification circuit 31 placed between the IC terminal 15*c* and the ground line 14, the differential amplification circuit 31 comprising transistor Q25 to Q32 and resistors R18 to R21, as shown in FIG. 3. Since a voltage entering the operational amplifier 22 is comparatively smaller (i.e., the input voltage is close in amount to the battery voltage VB), the transistors Q25 and Q26 placed to accept a differential input is composed of an NPN-type transistor. In association with this, each of the transistors Q27 and Q28 each of which composes a constant-current circuit is arrange d between each of the transistors Q25 and Q26 and each of the transistors Q29 and Q30 for driving active loads. Bases of the transistors Q31 and Q32 for supplying a constant current to both the transistors Q27 and Q28 are coupled with the cathode of the foregoing diode D12 and the base of the foregoing transistor Q20, respectively.

At the output-side stage in the differential amplification circuit 31, there is provided an output circuit 32 comprising transistors Q33 to Q35, diodes D14 and D15, resistor R22, constant-current circuits 33 and 34, and capacitor C13 for phase compensation. The diodes D14 and D15 are connected in series between a collector of the transistor Q34 and the ground line 14 and will limit an increase in a voltage at a collector of the transistor Q34, which is caused when the transistor Q34 is turned off, so that the operation speed is speeded up.

Figure 4:
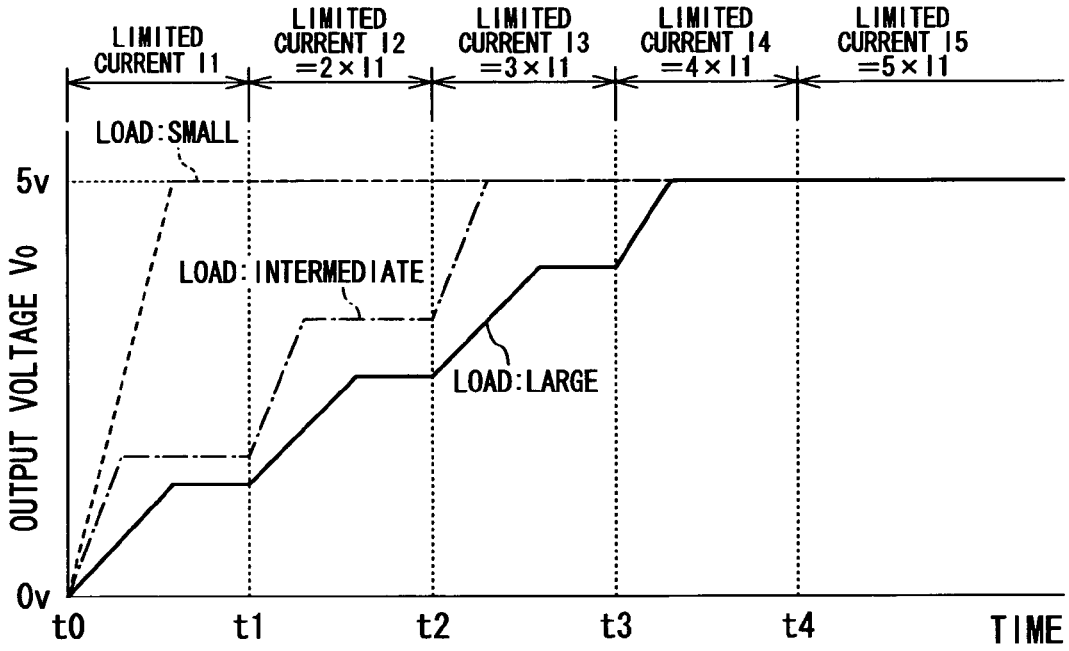
FIG. 4 exemplifies waveforms explaining various startup operations of an output voltage Vo.

Referring to FIGS. 4 to 6 as well as FIGS. 2 and 3, the operation of the power supply circuit 11 will now be described.

When a battery voltage VB is applied to the input terminal 12 of the power supply circuit 11, the operational amplifier 18 operates to amplify a difference voltage between the reference voltage Vr and a detected voltage Va to give a resultant amplified voltage to the base of the transistor Q12. This makes it possible to control a base current at the transistor Q11 via the transistor Q12, whereby an output voltage Vo is controlled at a constant voltage of 5 volts to be targeted (i.e., voltage tracking control).

In addition to this constant voltage control, the power supply circuit 11 is able to conduct current limiting control. This current limiting control aims at not only preventing an excessive output current Io from flowing, even when an overload state or a load-short-circuited state occurs, thus protecting the circuitry, but also suppressing an overshoot when the output voltage Vo rises. Hereinafter, the suppression of an overshoot will now be detailed.

When the battery voltage VB is applied to the input terminal 12, the output voltage Vo starts rising from 0 V and the timer circuits 30*a* to 30*d* arranged in the current limiter 19 start counting all at once (time t0). The times t1 to t4 set in each of the timer circuit 30*a* to 30*d* are related to each other by the following expressions:

$$t2=2*t1 \quad (2)$$

$$t3=2*t2 \quad (3)$$

$$t4=2*t3 \quad (4),$$

wherein the time t1 is set to a period of time of about several hundreds μsec.

During the counting operation of each of the timer circuits 30*a* to 30*d*, the transistors 24*a* to 24*d* each included in the reference-current generating circuits 28*a* to 28*d* are in its on-state, results in that the transistors Q21*a* to Q21*d* and Q22*a* to Q22*d* are in their off-states and current flowing each of the diodes D13*a* to D13*d* is zero. Accordingly, during a period of time from the time t0 to a time t1 at which the timer circuit 30*a* finishes its counting operation, only a reference current i1 flows through the resistor R15 via the transistors Q15 and Q16.

In this state where only the reference current i1 flows, voltages VP and VM respectively appearing at the non-inverting and inverting input terminals of the operation amplifier 22 can be expressed by the following expressions (5) and (6):

$$VP=VB-i1*R15 \quad (5)$$

$$VM=VB-Io*R15 \quad (6),$$

wherein R12 and R15 are resistance values of the resisters R12 and R15.

In addition, a limited current I1 based on the reference current i1 can be set to an amount defined by the following expression (7):

$$I1=(i1*R15)/R12 \quad (7),$$

wherein I1 in this embodiment is designed to 150 mA.

In cases where the relationship VP<VM is established, that is, the output current Io is smaller than the limited current I1, the output voltage of the operational amplifier 22 becomes 0 V, thus the transistor Q13 is turned off. Hence the foregoing constant voltage control makes the output voltage Vo rise upward to the target voltage. In contrast, when the relationship of VP>VM is realized, the output voltage of the operational amplifier rises, whereby the transistor Q13 turns on and the transistors Q12 and Q11 turn off. The output current Io is therefore forced to decrease. Through control, the output current Io is limited up to the limited current I1, and an equilibrium state of VP=VM is established.

FIG. 4 shows various waveforms observed when the output voltage Vo rises, in which the longitudinal axis denotes the time and the lateral axis denotes the voltage. In FIG. 4, a solid line, a chain line, and a broken line represent output voltage waveforms obtained for a large load (R12=9 Ω), an intermediate load (R12=12 Ω), and a small load (R12=40 Ω), respectively. When the load is small, the current limitation will not be effective, so that the output voltage Vo reaches the target voltage of 5 V prior to the time instant t1. By contrast, the larger the load, the larger the limitation to the output current Io, as stated above. Hence when the load is large, the output current Io is finally limited to I1 and the output voltage Vo stops rising as soon as "I1*R12" is realized.

In cases where the current limitation is obtained and the counting operation at the timer circuit 30*a* is ended at the time instant t1 after the output voltage Vo stops rising, the transistors Q24*a*, Q21*a* and Q22*a* turn on, thus a current i1 flowing through the diode D13*a*. Accordingly, during a period of time from the time instant 'to a time instant'at which the timer circuit 30*b* completed its counting operation, another reference current I2(=2·il) flows through the resistor R15. Another limited current 12 based on the reference current i2 can be set to an amount defined by the following expression (8):

$$I2=(i2*R15)/R12 \quad (8),$$

wherein I2 in this embodiment is designed to 330 mA.

Because the limited current is doubled stepwise from I1 to I2, the output voltage Vo for the intermediate or large load starts to rise again, and then stops its rising at a time instant when the output voltage Vo becomes "I2*R12." After the time instant t2, the output voltage Vo behaves in a similar way to the above, so that, during a period of time from the time instant t2 to a time instant t3, another period of time from the time instant t3 to a time instant t4, and another period of time from the time instant t4 to a time instant t5, a reference current i3 (=3*i1), another reference current i4 (=4*i1), and another reference current i5 (=5*i1) will flow through the resistor R15, respectively. Limited current s I3, I4 and I5 derived from the reference current i3, i4 and i5 can be set to amounts defined from the following expressions (9), (10) and (11):

$$I3=(i3*R15)/R12 \quad (9)$$

$$I4=(i4*R15)/R12 \quad (10)$$

$$I5=(i5*R15)/R12 \quad (11),$$

wherein I3, I4 and I5 in this embodiment are designed to 450 mA, 600 mA and 750 mA, respectively.

As shown in FIG. 4, in the current limitation for the intermediate load, no current limitation will be effected after the limited current reaches I3 (=450 mA), while the output voltage Vo reaches the target voltage of 5 V. Like this, in the current limitation for the large load, no current limitation will be effected after the limited current reaches I4 (=600 mA), while the output voltage Vo reaches the target voltage of 5 V.

The limited current I5 (=750 mA), which comes after the output voltage Vo completes its rise is designated to an amount larger than a possible maximum current flowing into a load in a normal state under the output voltage Vo of 5 V. As a result, the foregoing current limiting control will not prevent the constant voltage control.

As stated above, when the output voltage Vo rises, the present current limiting control operates such that the output current Io is allowed to increase stepwise by a constant current amount of 150 mA at predetermined constant intervals t1. Thus, the output voltage Vo increases little by little with an increase in the limited current. This control reduces or suppresses an overshoot rising in the output voltage Vo reaching the target voltage 5 V.

Figure 5A:
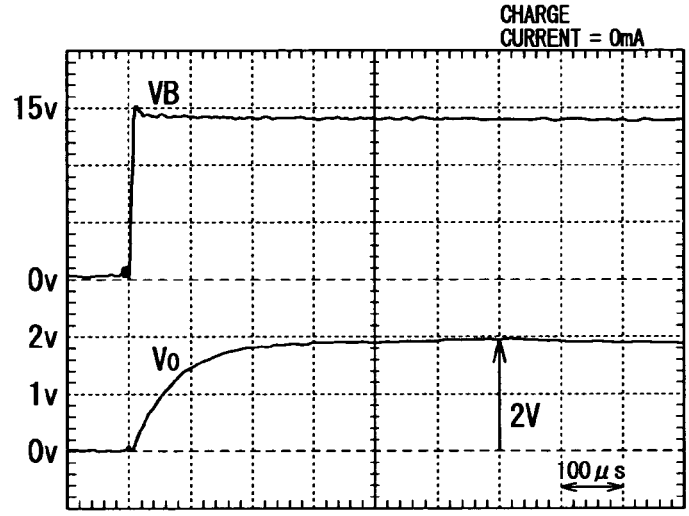
FIGS. 5A to 5C are starting-up waveforms of an input voltage VB and an output voltage Vo obtained by a test conducted for studying current-limiting control.
Figure 5B:
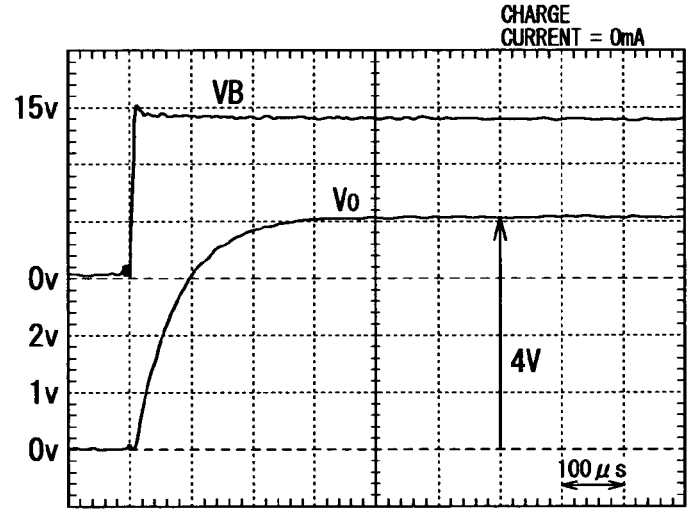
Figure 5C:
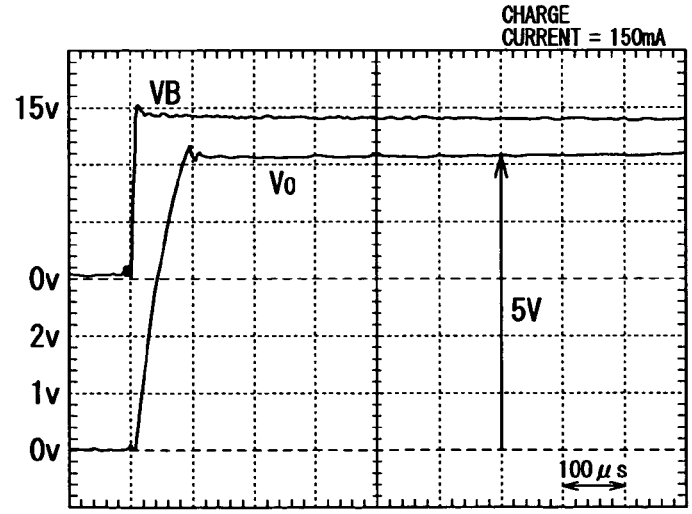
Figure 6A:
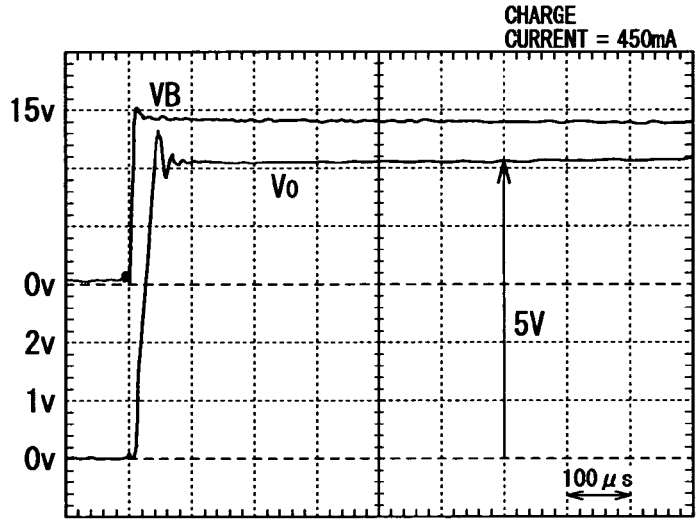
FIGS. 6A to 6C are starting-up waveforms of an input voltage VB and an output voltage Vo obtained by a test conducted for studying current-limiting control.
Figure 6B:
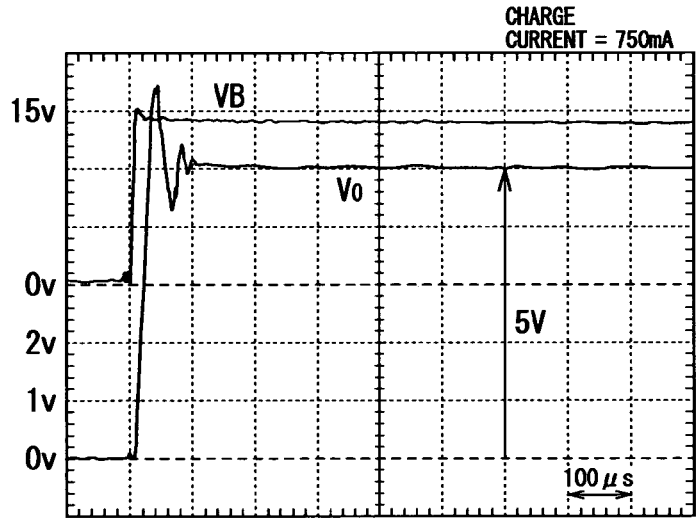
Figure 6C:
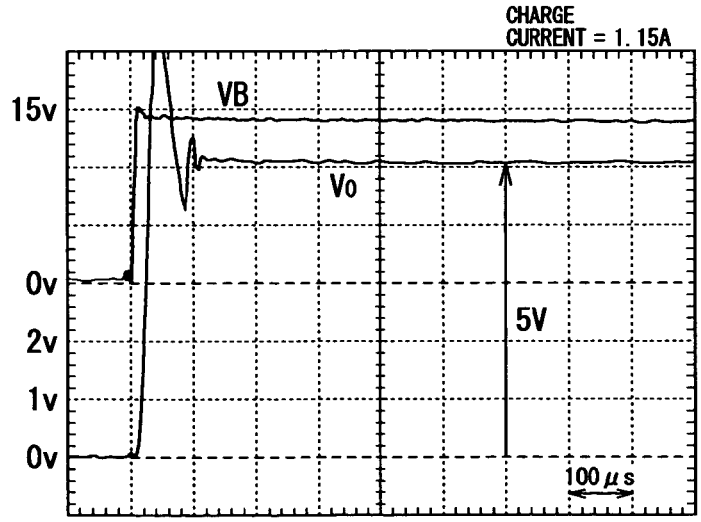

The present inventors decided both the time interval t1 and the current step I1 which are required in increasing the limited current stepwise, on the basis of test results shown in FIGS. 5A to 5C and 6A to 6C. The results in each figure show both of the voltage VB at the terminal 12 and the output voltage Vo which are raised on condition that the resistor R11 has a resistance of 20 Ω, the capacitor C12 has a capacitance of 3.3 μF, and the limited current value is set to a constant value. FIGS. 5A, 5B and 5C show the results obtained under a limited current of 100 mA, 200 mA and 400 mA, respectively, and FIGS. 6A, 6B and 6C show the results obtained under the limited current of 700 mA, 1 A and 1.4 A, respectively.

In the case that the output voltage Vo is controlled to a target voltage of 5 V, a current of 250 mA flows through the resistor R11. Thus, as shown in FIGS. 5A and 5B, when a limited current is below 250 mA, the output voltage Vo is impossible to reach 5 V. On the other hand, as shown in FIGS. 5A to 5C, the larger the limited current, the larger the current flowing into the capacitor C12, so that a larger overshoot occurs. Considering these results, an overshoot in FIG. 5C, which was obtained under a limited current of 400 mA, seemed reasonable, so that this overshoot was designated as a target. In this condition, a current flowing through the capacitor C12 (i.e., charge current) is 150 mA (=400 mA −250 mA).

In other words, provided that the current changes within a span of 150 mA while the output voltage Vo is raised up to the target voltage 5 V, it is possible that an overshoot can be suppressed down to such a degree that FIG. 5C shows. Under this study, the current step I1 is designated as 150 mA. In addition, since the load current is at most 750 mA (R11=6.6 Ω), a time constant obtained when a capacitance of the capacitor C12 is set to 3.3 μF is several tens of microseconds. Hence the time interval tl was set to several hundreds of microseconds, including an appropriate allowance.

In this way, the power supply circuit 11 according to the present embodiment is provided with the current limiter 19, which is able to generate a limited value of the output current Io in a stepwise fashion as the time elapses, in response to the rising of the output voltage Vo (i.e., the voltage tracking control is started or the battery voltage VB is applied to the input terminal 12 under the voltage tracking control). Thus, the output current Io is controlled so as to increase gradually as the time elapses. This increase of the output current Io in a controlled manner will cause the output voltage Vo to increase stepwise, with the result that an overshoot of the output voltage Vo can be reduced. Accordingly, the overshoot can be suppressed, while still reducing the capacitance of the capacitor C12 connected to the output terminal. Additionally, a chip type of capacitor can be used as the capacitor C12, whereby the power supply circuit 11 can be minimized in size and manufacturing cost of the circuit can be lessened.

Further, the limited current I5 required after the output voltage Vo has risen to the target voltage of 5 V is set to an amount (in the above example, 750 mA) satisfying the condition the amount should be over a maximum current value necessary by the load and should be able to suppress an excessive current flowing responsively to an overload and/or a short-circuited load, thus protecting the circuit from being damaged. As a result, in the normal operation state, the voltage tracking control gives exactly an output voltage Vo of 5 V to be targeted, while in an abnormal operation state, the current limiting control will limit the output current Io to an amount I5.

(Second Embodiment)

Figure 7:
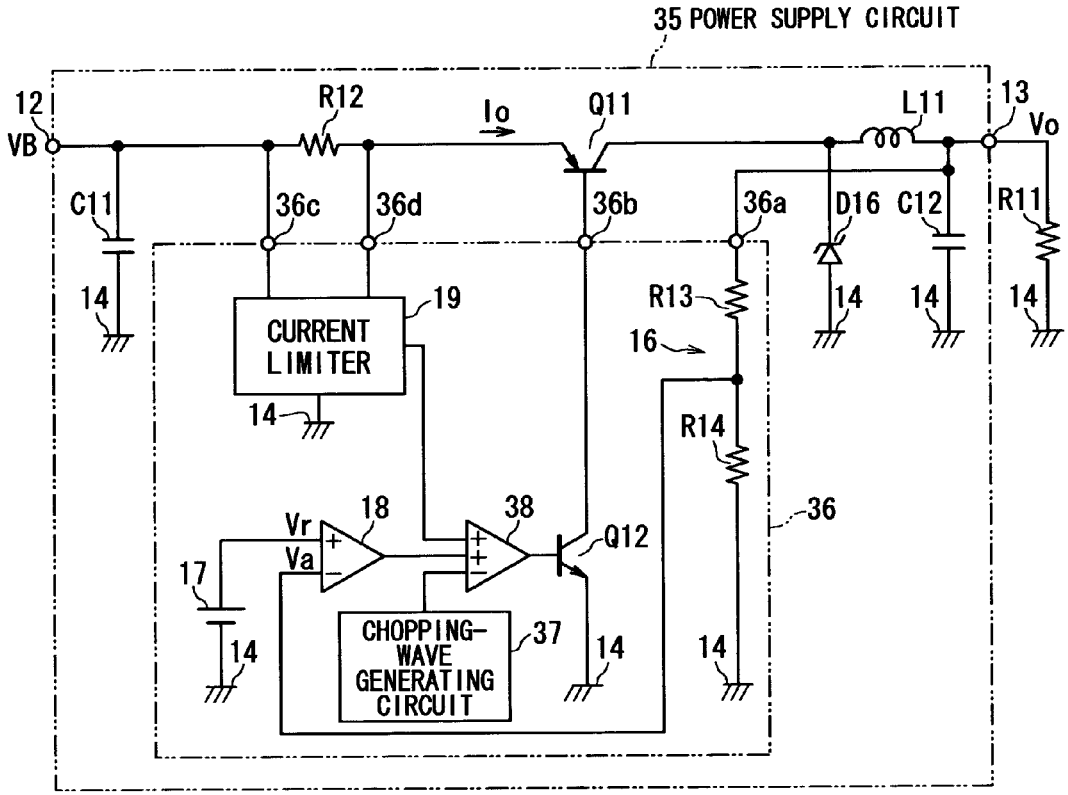
FIG. 7 shows the electrical configuration of a power supply circuit according to a second embedment of the present invention.

Referring to FIG. 7, a second embodiment of the present invention will now be described.

FIG. 7 shows, partly into a block form, the circuitry of a chopper type of switching power supply circuit 35 according to the second embodiment. This power supply circuit 35 steps down an inputted battery voltage VB to output a target voltage of 5 V. In FIG. 7, for the sake of a simplified explanation, the identical or similar components to those of the power supply 11 in FIG. 2 are assigned to the same references as those in FIG. 2.

As shown in Fig, 7, a reactor L11 is electrically connected between the collector of the transistor Q11 and the output terminal 13, while a Zener diode D16 is electrically connected between the collector of the transistor Q11 and the ground line 14 for protection from an excessive voltage and current flywheel. The polarities of the Zener diode D16 is oriented in the circuitry as it is shown in FIG. 7. The power supply circuit 35 is provided an IC 36 manufactured under a bipolar process. The IC 36 is arranged to control the operation of the transistor Q11.

The IC 36 is equipped with, like the IC 15 shown in FIG. 2, a voltage detecting circuit 16, reference voltage generating circuit 17, operational amplifier 18, current limiter 19, transistors Q12, chopping-wave generating circuit 37, and comparator 38. The chopping-wave generating circuit 37 generates chopping waves whose amplitudes are specified, which are fed to an inverting input terminal of the comparator 38. The comparator 38 has first and second non-inverting input terminals, which are respectively coupled with output terminals of the current limiter 19 and the operational amplifier 18. The inverting input terminal of the comparator 38 is coupled to an output terminal of the chopping-wave generating circuit 37. An output terminal of the comparator 38 is coupled with the base of the transistor Q12.

In the above configuration, the comparator 38 operates to mutually add output signal from the current limiter 19 and the operational amplifier 18, and compares the resultant added signal to the chopping wave signal. As a result, the comparator 38 is able to turn on the transistor Q12 when the added signal is larger in amplitude the chopping wave signal, so that during a period of time when the added signal is over the chopping wave signal, the transistor Q11 is driven to be in the on-state via the transistor Q12. The duty ratio (on-state period) of the transistor Q11 is thus controlled so that the output voltage Vo is subjected to constant-voltage control (i.e., voltage tracking control), thus the output voltage Vo being consistent with a target voltage of 5 V. On the other hand, when the output current Io is obliged to flow excessively, the current limiter 19 will previously provide a countermeasure by reducing its output signal. In response to this reduction in the output signal, the duty ratio is also reduced to lower the output voltage Vo, thereby providing a limitation to the output current Io.

In this embodiment, in response to application of the battery voltage VB to the input terminal 12, the current limiter 19 will cause a limited current value to the output current Io to stepwise increase by a specified current of 150 mA at intervals of time t1. The control of the limited current value makes it possible to increase the output voltage Vo stepwise responsively to an increase in the limited current value, resulting in that an overshoot due to the output voltage Vo reaching the target voltage of 5 V can be reduced.

Conventionally, this type of power supply circuit has required a soft-start circuit to gradually raise the duty ratio in starting up the power supply circuit, but the present embodiment will eliminates the need for such a circuit.

By the way, as described in the foregoing first and second embodiments, the rise rate of an output voltage is actively and directly controlled when the power supply circuit is put into its operation, so that the generation of an overshoot of the output voltage is almost prevented or remarkably suppressed. However, in cases where this power supply circuit is applied to, for instance, an ECU (Electrical Control Unit) for use in vehicles, there is a further need for improvement in the rising characteristics of an output voltage of the power supply circuit, which is as follows.

The ECU is usually located in the vicinity of a lower part of the assistant driver's seat, and relatively far from the battery mounted in the engine room. The length of wires from the battery to the ECU is therefore several meters, so that an inductance component distributed along the wires will not be negligible and not affect a switchover of an ignition (IG) switch. That is, it is frequent that a switchover of the ignition switch from the off-state to the on-state will cause, more or less, an inrush current from the battery to the ECU, and the inrush current brings about a ringing phenomenon in an input voltage to the ECU.

If the ringing phenomenon occurs in the course of a rising output voltage, the ringing will also appear so as to be superposed on the output voltage controlled to increase linearly, thus affecting the circuit of a load connected to this power supply circuit. One example is that, if the load circuit is a microcomputer, the microcomputer might fail to properly respond to a reset command while the power supply circuit is in its startup operation.

Therefore, the following various embodiments are provided to further improve the rising characteristics of an output voltage of the power supply circuit. To be specific, a ringing phenomenon appearing in the output voltage generated when the output voltage rises at a controlled rate is prevented or suppressed down to an almost negligible level.

(Third Embodiment)

Referring to FIGS. 8 to 11, a third embodiment of the present invention will now be described.

Figure 8:
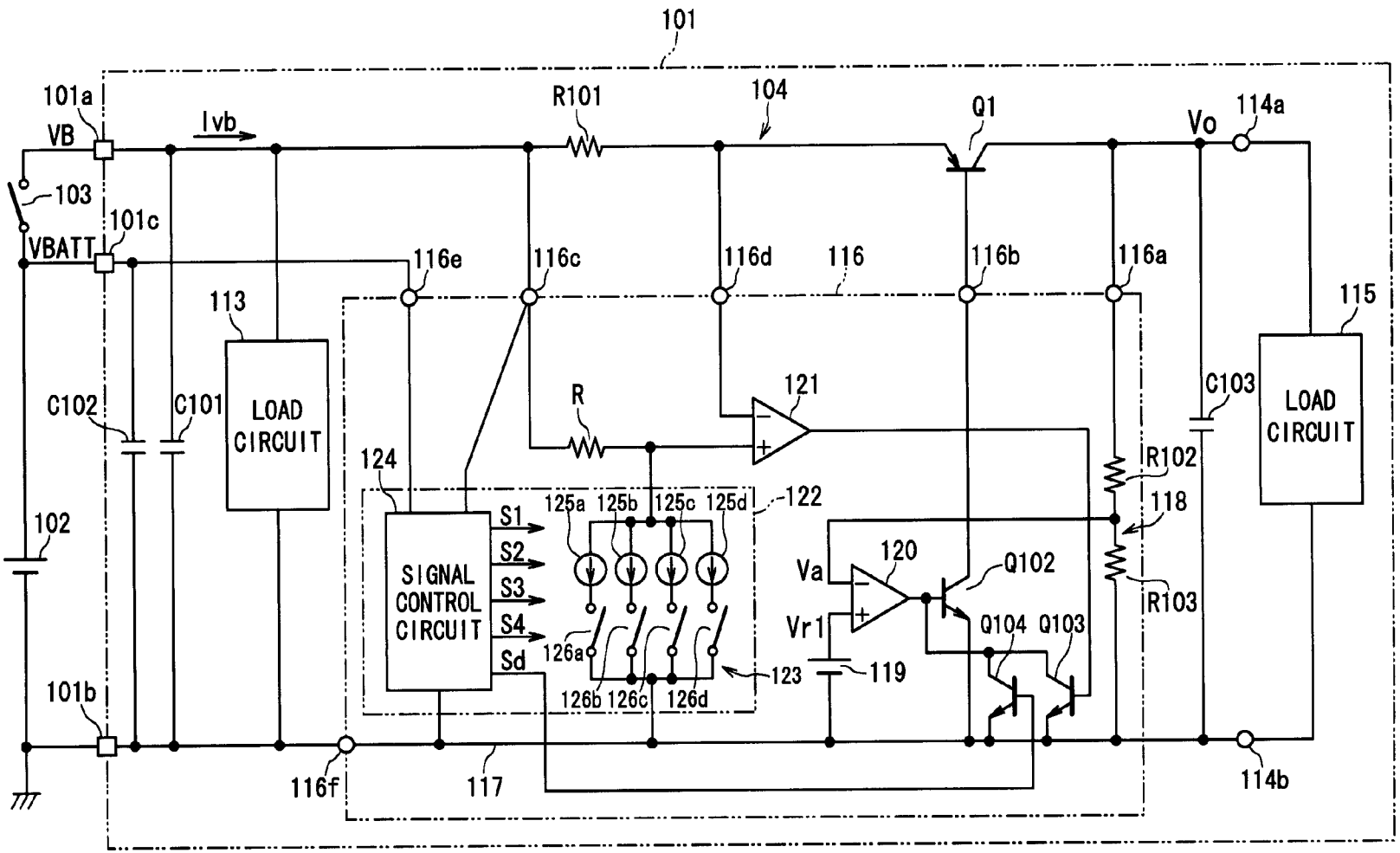
FIG. 8 shows the electrical configuration of a power supply circuit according to a third embedment of the present invention.

FIG. 8 details the configuration of electrical circuitry of a series-regulator-type of power supply circuit, which is incorporated in an ECU 100 for use in an automobile engine.

The ECU 100 has an input terminal 101*a*, to which a positive polarity terminal of a battery 102 is connected via an ignition switch 103. The ECU 100 has further terminals 101*c* and 101*b*, to which the positive and a negative polarity terminals of the battery 102 are connected, respectively. In the following description, a battery voltage given to one input terminal 101*a* is denoted as VB and a further battery voltage given to the other input terminal 101*c* is denoted as VBATT.

Figure 9:
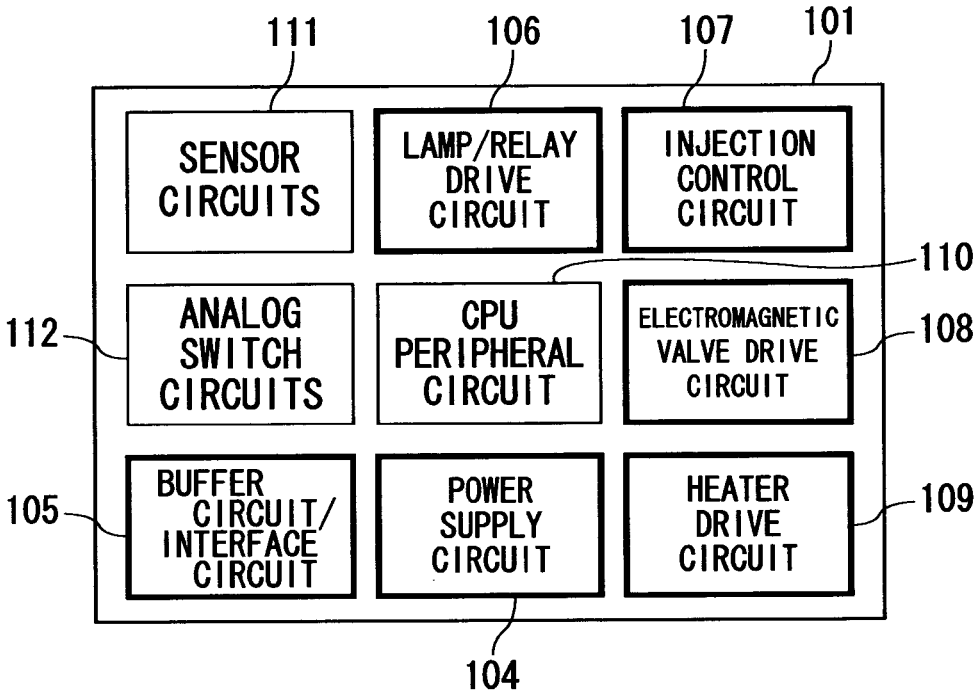
FIG. 9 explains in block form various circuits mounted in an ECU.

The ECU 100 has a variety of circuit blocks, which are illustrated in FIG. 9. In the ECU 100, as shown therein, there are circuit blocks drawn by bold solid lines, that is, a power supply circuit 104, buffer circuit/interface circuit 105, lamp/ relay drive circuit 106, injection control circuit 107, electromagnetic valve drive circuit 108, and heater drive circuit 109, which are all designed to operate on voltage served by the battery voltage VB. These circuits 105 to 109 (except for the power supply circuit 104) are brought together and denoted as a load circuit 113 connected to the terminals 101*a* and 101*b* in FIG. 8. Meanwhile, in the ECU 100, there are circuits drawn by thin solid lines, that is, a CPU peripheral circuit 110, sensor circuits 111, and analog switch circuits 112, which are designed to operate on a voltage of 5 V supplied from this power supply circuit 104. These circuits 110 to 112 are brought together and denoted as a load circuit 115 connected to output terminals 114*a* and 114*b* of the power supply circuit 104 shown in FIG. 8.

As shown in FIG. 8, smoothing (filtering) capacitors C101, C102 and C103 are connected, respectively, between the terminals 101*a* and 101*b*, between the terminals 101*c* and 101*b*, and between the terminals 114*a* and 114*b*. In a current path (power transmission path) connecting the terminals 101*a* and 114*a*, there is formed a serial circuit consisting of a resistor R101 (i.e., forming current detecting circuit) and a PNP-type of transistor Q101 (i.e., forming a main transistor) with an emitter and a collector of the transistor Q101 connected to both the terminals. The transistor Q101 is controlled by an IC 116.

In this IC 116, there are provided resistors R102 and R103 for dividing voltage. That is, between an IC terminal 116*a* connected to the terminal 114*a* and at a position of a ground line 117 within the IC 116, a serial circuit consisting of the resistors R102 and R103 is connected to form a voltage detecting circuit 118. An intermediate connection between the resistors R102 and R103 produces a detected voltage Va produced by dividing an output voltage Vo by a ratio between the resistors R102 and R103.

The IC is still provided with a reference voltage generating circuit 119 (forming a reference voltage producing circuit) composed of a band-gap reference voltage circuit and others. This circuit 119 generates a given reference voltage Vr1 corresponding to a target voltage (5 V). To a non-inverting and inverting input terminals of an operational amplifier 120 (forming a voltage control circuit) incorporated in this IC 116, the reference voltage Vr1 and the detected voltage Va are applied, respectively.

An NPN-type transistor Q102 is provided in the IC 116 so that a collector and an emitter of the transistor Q102 are connected, respectively, to both of an IC terminal 116*b* connected to a base of the foregoing transistor Q101 and the ground line 117. A base of the transistor Q102 is connected with an output of the operational amplifier 120. Further NPN-type of transistors Q103 and Q104 are provided in parallel to each other in the IC 116 so that a collector and an emitter of each transistor are coupled with both of the base of the transistor Q102 and the ground line 117, respectively. The transistor Q104 forms a shutoff circuit of the present invention.

An input-side terminal of the resistor R101 is connected to a non-inverting input terminal of a comparator 121 (forming a current limiting circuit) via an IC terminal 116*c* and a resistor 104 in turn, while an output-side terminal of the resistor R101 is connected to an inverting input terminal of the comparator 121 via an IC terminal 116*d*. An output of the comparator 121 is routed to a base of the foregoing transistor Q103.

The IC 116 also includes a startup control circuit 122 in charge of controlling a rise rate of the power supply circuit 104 in response to turning the ignition switch 103 on. This startup control circuit 122, which is designed to operate on the battery voltage VBATT supplied at any time via IC terminals 116*e*and 116*f*, comprises a reference-current producing circuit 123 and a signal control circuit 124. Of these, the reference-current producing circuit is configured to produce a reference current that flows through the resistor 104, the reference current being increased stepwise. The signal control circuit 124 is configured to produce both switchover signals S1 to S4 sent to the reference-current producing circuit 123 and a control signal Sd (corresponding to a rise start signal) sent to the foregoing transistor Q104.

To be specific, the reference-current producing circuit 123 is placed between the non-inverting input terminal of the comparator 121 and the ground line 117 and comprises four serial circuit systems which are mutually connected in parallel, each serial circuit system consisting of a constant-current circuit 125*a* (125*b*, 125*c* and 125*d*) and an analog switch 126*a* (126*b*, 126*c* and 126*d*). The constant-current circuits 125*a* to 125*d* is formed to output reference currents I1 to I4, which are all set to be equal to an amount Ia. The number of parallel-arranged serial circuit systems corresponds to the number of switchovers of reference currents required for controlling the startup operation. When each of the switchover signals S1 to S4 becomes an "H (High)" level, each of the analog switches 126*a* to 126*d* turns on.

Figure 10:
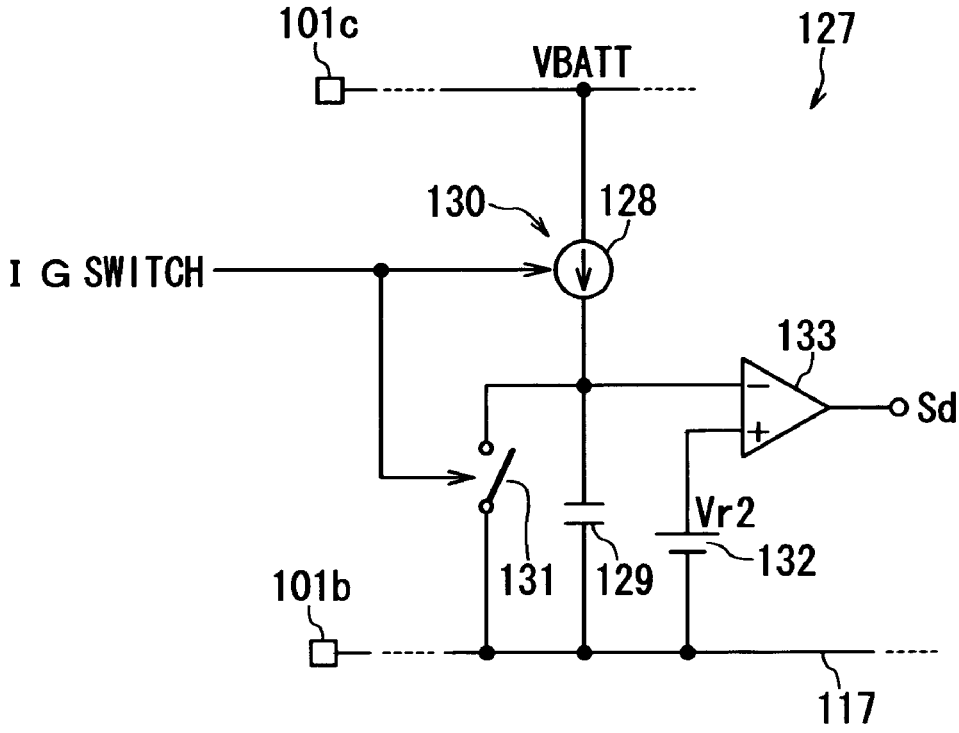
FIG. 10 shows the electrical configuration of a control-signal producing circuit employed in the third embodiment.

Furthermore, the signal control circuit 124 is provided with a control-signal producing circuit 127 (corresponding to a delay control circuit) shown in FIG. 10. This control-signal producing circuit 127, which produces the foregoing control signal Sd by making use of a time for charging a capacitor, comprises a charge circuit 130 that includes a serial circuit consisting of a constant-current circuit 128 and a capacitor 129; a discharging switch circuit 131 connected to both ends of the capacitor 129; a reference-voltage generating circuit 132 that generates a reference voltage Vr2; and a comparator 133 (forming a comparative circuit) that draws a comparison between a terminal voltage across the capacitor 129 and the reference voltage Vr2. By the way, the constant-current circuit 128 is designed to provide a constant current only when the ignition switch 103 is in the on-state, while the switch circuit 131 is kept to the on-state only when the ignition switch 103 is in the off-state.

Though not shown, the signal control circuit 124 has timer circuits used to produce the switchover signals S1 to S4. Responsively to a transition of the signal Sd to H-level, the switchover signal S1 switches over from L (Low)-level to H-level, and then, every time each timer circuit counts a specified period of time T, the remaining switchover signals S2 to S4 transit from L-level to H-level in sequence. Both of the timer circuits and the reference-current producing circuit 23 compose the limited-current-value setting circuit according to the present invention.

Figure 11A:
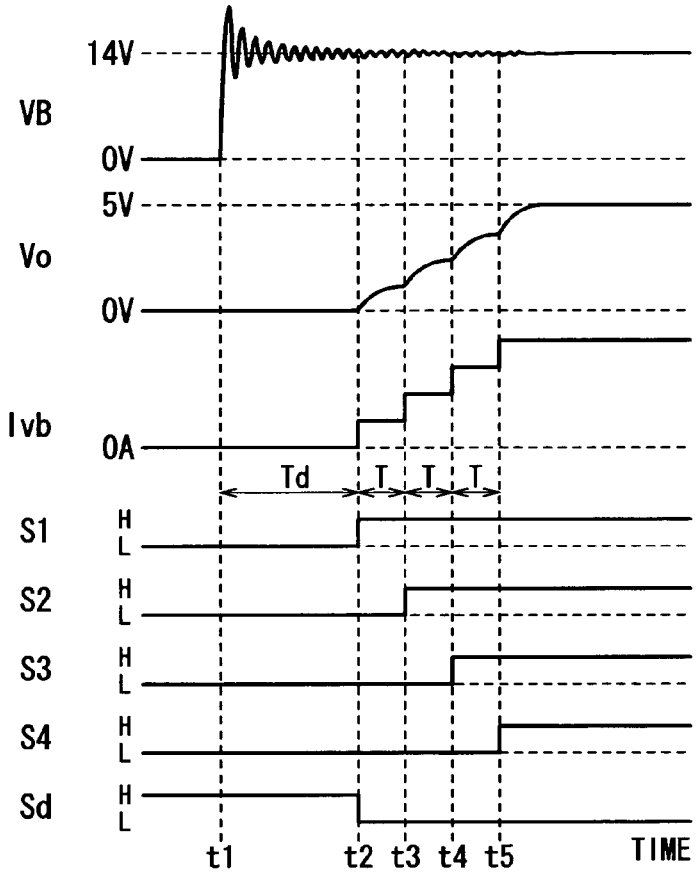
FIG. 11A is a timing chart showing the operations of the power supply circuit according to the third embodiment.
Figure 11B:
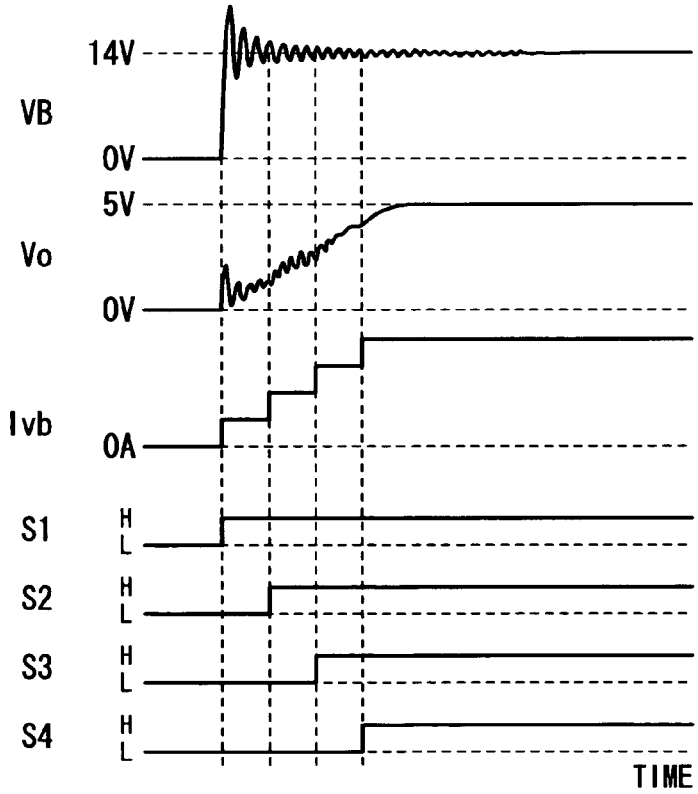
FIG. 11B is a further timing chart showing the operations of a power supply circuit introduced for comparison with the operations in the third embodiment.

Referring to FIGS. 11A and 11B, the operation of the power supply circuit 104 will now be explained.

FIGS. 11A and 11B show waveforms at each of some positions in the circuitry during the startup operation of the power supply, which responds to a switchover of the ignition switch 103 from the off-state to the on-state. Of these figures, FIG. 11A shows the waveforms realized in the power supply circuit 104 according to the present embodiment, while FIG. 11B shows the waveforms realized in a configuration formed by removing from the power supply circuit 104 both the control-signal producing circuit 127 and the transistor Q104. The waveforms in FIGS. 11A and 11B show, from the top, in turn, the battery voltage VB, the output voltage Vo, a current Ivb flowing through the resistor R1, the switchover signals S1 to S4, and the control signal Sd (only in FIG. 11A).

As described before, the ECU 101 is frequently disposed in the vicinity of the assistant driver's seat in an automobile, whereby the length of wires connecting the battery 102 mounted in the engine room the ECU 101 tends to be longer. An inductance component is distributed along the wires, so that a switchover of the ignition switch 103 from the off-state to the on-state usually causes an inrush current flowing suddenly from the battery 102 to the capacitors C101 and C102. Thus, a ringing component appears on the battery voltage VB and gradually decays as the time elapses.

When the ignition switch 103 is in the off-state, the switch circuit 131 in the control-signal producing circuit 127 is in the on-state, thus the terminal voltage across the capacitor 129 being 0 V, thus the control signal Sd being H-level. This keeps the on-state of the transistor Q104 and keeps the off-state of the transistors Q102 and Q101, so that no output voltage is supplied from the power supply circuit 104. In this state, the switchover signals S1 to S4 are all in L-level.

In FIG. 11A, when the ignition switch 103 turns on at a time instant t1, the switch circuit 131 in the control-signal producing circuit 127 turns off, which makes the constant-current circuit 128 start to output a constant current. Hence charging the capacitor 129 is started, and at a time instant after a delay time Td from the time instant t1, the terminal voltage across the capacitor 129 reaches the reference voltage Vr2, thereby making the control signal Sd transit from H-level to L-level. Since a decreasing characteristic of the ringing amount superposed on the battery voltage VB can be predicted, the above delay time Td is set to an amount that makes it possible that a monotone increase is steadily given to the output voltage Vo increasing responsively to a stepwise increase control for current-limiting amounts, which will follow bellow.

In response to a switchover of the control signal Sd to L-level, the signal control circuit 124 turns the switch signal S1 from L-level to H-level. Hence, the transistor Q104 becomes the off-state, while the transistors Q102 and Q101 become the on-state. Concurrently, a reference current I1 originated from the constant-current circuit 25*a* flows through the resistor R104, so that the current-limiting control carried out by the comparator 21 will produce a current Ivb that serves as a limited current value, which can be expressed by the following expression (12):

$$Ivb=I1*R4/R1=Ia*R4/R1 \quad (12)$$

Then, whenever a predetermined period of time T elapses sequentially from the time instant t2, that is, at each of time instants t3, t4 and t5, the signal control circuit 124 turns the remaining switchover signals S2, S3 and S4 from L-level to H-level in turn. Thanks to the current-limiting control carried out by the comparator 121, the current Ivb corresponding to each of the switchover signals S2 to S4 is increased sequentially, but limited to a current value shown by each of the following expressions (13) to (15):

$$Ivb=(I1+I2)*R4/R1=2*Ia*R4/R1 \quad (13)$$

$$Ivb=(I1+I2+I3)*R4/R1=3*Ia*R4/R1 \quad (14)$$

$$Ivb=(I1+I2+I3+I4)*R4/R1=4*Ia*R4/R1 \quad (15)$$

In short, as shown in FIG. 11A, when the ignition switch 103 turns on, the power supply circuit 104 does not start its startup operation, but waits for a period of delay time Td during which the ringing component superposed on the battery voltage VB decays. After the delay time Td, the power supply circuit 104 will start its startup operation in the stepwise mode.

During the stepwise startup operation, the current-limiting control provided by the comparator 121 becomes effective, instead of the constant-voltage control provided by the operational amplifier 120. Hence, direct feedback control for fluctuations in the output voltage is unusable, so that the output voltage Vo is likely to fluctuate due to fluctuations in the inputted battery voltage VB.

However, when the startup operation is started, the ringing component superposed on the battery voltage VB has fully been decayed. As a result, fluctuations (ringing components) in the output voltage Vo due to the ringing components on the battery voltage VB is sufficiently small, it is assured that the output voltage Vo increases in a monotone increase fashion.

The load circuit 115 contains the CPU peripheral circuit 110, and this circuit 110 has a reset circuit working on the output voltage Vo. This reset circuit is designed to, for instance, release a reset in cases where the output voltage Vo exceeds 3 V, and to issue a reset signal to allow an access to external memories or others in cases where the output voltage Vo exceeds 4 V. Because the monotone (linear) increase in the output voltage Vo is assured during the startup operation, the above reset circuit is able to issue a reset signal in a steady manner, with erroneous reset actions be avoided almost completely.

Meanwhile, if the foregoing delay control on the delay time Td will not be carried out, the behaviors in such a case can be explained as in FIG. 11B. That is, from immediately after turn the ignition switch 103 on, the switchover signals S1 to S4 change to H-level successively at intervals of time T, thus starting a stepwise increase of the limited current value. Thus the output voltage Vo is obliged to increase while the ringing component is still large on the battery voltage VB (i.e., the fluctuations in the battery voltage VB is still large), thus fluctuations in the output voltage Vo becoming larger due to the remaining component. This drawback is surely improved by the present invention, as stated in FIG. 11A.

As described above, the power supply circuit 104 according to the present embodiment is able to further enhance the advantageous rising characteristic of power. That is, this power supply circuit 104 assures that fluctuations in the output voltage, which is due to a ringing component superposed on the battery voltage VB during the startup operation, are avoided almost completely or suppressed to a lower level. The output voltage is made to increase as linearly as possible. This linearity-assured increase in the output voltage allows a startup operation and an initializing operation to be carried out smoothly and steadily in the load circuit 15. In addition, setting the delay time Td to a longer amount will lead to a reduction in the capacitance of the capacitor C101, whereby contributing to a more-compact power supply circuit 104 and lowering manufacturing cost thereof. Further, the transistor 104 keeps the off-states of the transistors Q102 and Q101 during the delay time Td, the voltage output operation of the power supply circuit 104 can be stopped steadily even during a transitional period after the battery voltage VB is put into in the on-state.

Furthermore, like the first and second embodiments, the current Ivb is allowed to stepwise increase by a specific amount of current Ia whenever a specific period of time T elapses during the startup operation, whereby the output voltage Vo is also increased gradually with an increase in the limited current value. Therefore an overshoot occurring when the output voltage Vo rises up to a target voltage Vo can be avoided or suppressed remarkably. This can reduce the capacitance of the capacitor C103, thus making it possible to use a chip type of capacitor as the capacitor C103. it is hence possible to make the power supply circuit 104 more compact and reduce a manufacturing cost thereof.

(Fourth Embodiment)

Figure 12:
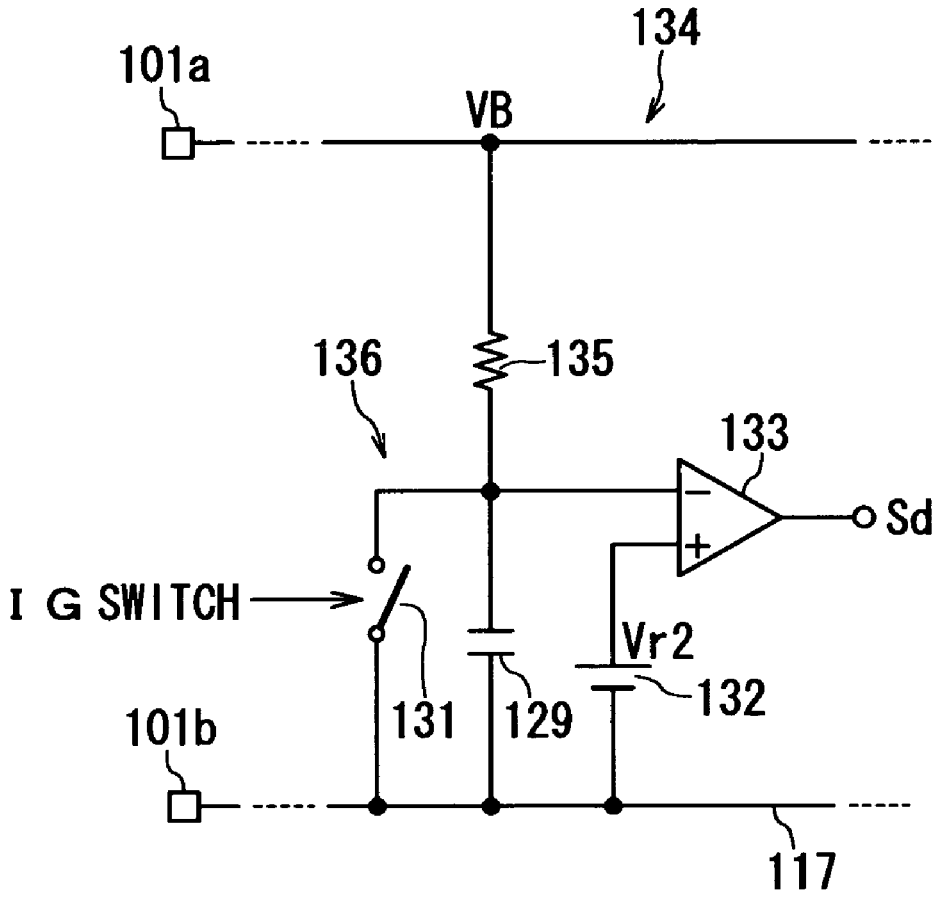
FIG. 12 shows the electrical configuration of a delay control circuit according to a fourth embodiment of the present invention.

Referring to FIG. 12, a fourth embodiment of the present invention will now be described. In this embodiment, in place of the foregoing control-signal producing circuit 127, another control-signal producing circuit 134 is used as a delay control circuit, as shown in FIG. 12, where the identical or similar components to those in FIG. 10 are denoted by the same references as those in FIG. 10.

The control-signal producing circuit 134, which also uses time to charge a capacitor to produce a control signal Sd, comprises a charge circuit 136 made up of a serial circuit of a resistor 135 and a capacitor 129, a switch circuit 131, a reference-voltage generating circuit 132, and a comparator 133. The charge circuit 136 is connected to both the terminals 101*a* and 101*b*.

In this circuitry, in response to a switchover of the ignition switch 103 from the off-state to the on-state, the switch circuit 131 is turned off and charging the capacitor 129 begins through the resistor 135. After a delay time Td, the terminal voltage across the capacitor 129 exceeds the reference voltage Vr2, whereby the control signal Sd transits from H-level to L-level. Using this control signal Sd provides the similar operations and advantages to those in the third embodiment concerning the startup operation of the power supply.

(Fifth Embodiment)

Figure 13:
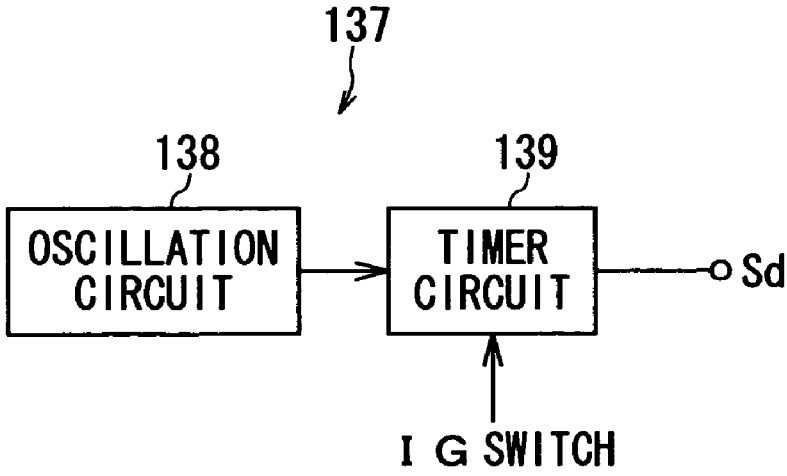
FIG. 13 shows the electrical configuration of a delay control circuit according to a fifth embodiment of the present invention.

Referring to FIG. 13, a fifth embodiment of the present invention will now be described. In this embodiment, in place of the foregoing control-signal producing circuit 127, another control-signal producing circuit 137 is used as a delay control circuit, as shown in FIG. 13.

This control-signal producing circuit 137 is equipped with an oscillation circuit 138 operating on the battery voltage VBATT and output an oscillation clock and a timer circuit 139 operating using the oscillation clock as a reference clock. When the ignition switch 103 is in the off-state, the timer circuit 139 outputs an H-level control signal Sd. When the ignition switch 103 turns on, the timer circuit 139 counts a predetermined period of time, and then turns the control signal from H-level to L-level.

This control signal Sd can be used for the starting up the power supply, like the foregoing third embodiment, thus providing the similar operations and advantages to those in the third embodiment.

(Sixth Embodiment)

Figure 14:
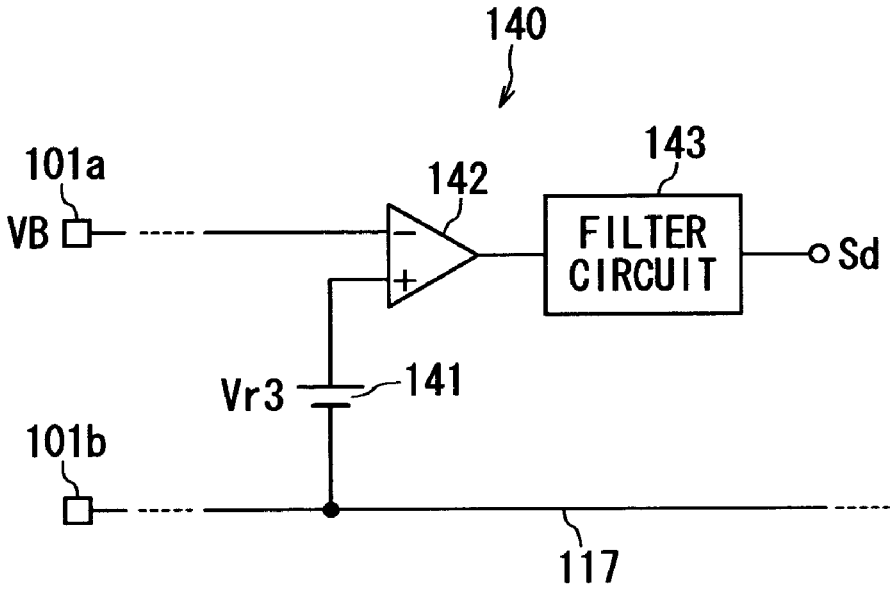
FIG. 14 shows the electrical configuration of a delay control circuit according to a sixth embodiment of the present invention.

Referring to FIG. 14, a sixth embodiment of the present invention will now be described. In this embodiment, in place of the foregoing control-signal producing circuit 127, another control-signal producing circuit 140 is used as a delay control circuit, as shown in FIG. 14.

This control-signal producing circuit 140 is configured to detect directly a ringing component of the battery voltage VB for producing the control signal Sd. To be specific, this circuit 140 is equipped with a reference-voltage generating circuit 141 for generating a reference voltage Vr3, a comparator 42 (corresponding to a comparison circuit) for drawing a comparison between the reference voltage Vr3 and the battery voltage VB, and a filter circuit 143 (corresponding to a constant-level detecting circuit).

Since the reference voltage Vr3 is set to a value closer to a stationary value (mean value) of the battery voltage VB, an output of the comparator 142 keeps changing as long as a ringing component of the battery voltage VB is large. The filter circuit 143, which receives an output signal of the comparator 142 at intervals, shits the control signal Sd from H-level to L-level in response to detecting that the output signal has been kept at the same level during a specified period of time.

Thus, this control signal Sd can be used for the starting up the power supply, thus providing the similar operations and advantages to those in the third embodiment. In addition, the controls-signal producing circuit 140 directly detects changes in the battery voltage VB, resulting in that a reduced ringing component can be found without fail. Thus the delay time becomes exact, so that a useless waiting period disappears.

(Modifications)

As partly explained above, the power supply circuit according to the present invention can be applied to a wide variety of types of power supply circuit, such as linear regulator, chopper-type switching regulator, and converter-type switching regulator. In such regulators, the main transistor is located to intervene in a power transmission path from its input terminal to its output terminal and respond to a command from a voltage control circuit and a current limiting circuit to actively control the power transmitted from the input terminal to the output terminal.

Moreover, in the foregoing the limited-current-value setting circuit 21 or startup control circuit 122 are not always limited to, as stated before, the configuration where limited current values to the output current Io for starting up the output voltage Vo or the current Ivb for starting up the power supply are stepwise increased by a specified amount at specified intervals of time, but may be modified as follows. For instance, in each stage corresponding to each period of time, the limited current values may be differentiated in their amplitude-change widths and/or their time intervals. Moreover, the number of stages for changing the limited current values is not restricted to five or four stages as listed in the foregoing embodiments, but may be replaced by an appropriately selected other number. It is generally true that the smaller the amplitude-change width to the current-limiting at each stage, the steadier the suppression of the foregoing overshoot. Still, the limited values for the output current may be increased continuously, instead of the stepwise-increase manner, so that the overshoot can be suppressed more steadily.

For the sake of completeness, it should be mentioned that the various embodiments and modifications explained so far are not definitive lists of possible embodiments. The expert will appreciates that it is possible to combine the various construction details or to supplement or modify them by measures known from the prior art without departing from the basic inventive principle.

The entire disclosure of Japanese Patent Applications No. 2002-005993 filed on Jan. 15, 2002 and No. 2002-204371 filed on Jul. 12, 2002 each including the specification, claims, drawings and summary is incorporated herein by reference in its entirety.

What is claimed is:

1. A power supply circuit comprising:

an electric switching element placed in a power transmission path connecting an input terminal to which an input voltage is applied and an output terminal through which an output voltage is applied to a load connected to the output terminal;

a voltage detecting circuit detecting the output voltage supplied through the output terminal;

a reference-voltage producing circuit producing a reference voltage in accordance with a target voltage;

a voltage control circuit controlling the electric switching element so that the detected output voltage tracks the reference voltage;

a current detecting circuit detecting an output current supplied through the output terminal to the load;

a limited-current-value setting circuit setting a limited value to the output current, the limited value increasing gradually over time during a rise of the output voltage up to the target voltage; and a current limiting circuit controlling the electric switching element to keep the detected output current at a current value less than or equal to the limited value during the rise of the output voltage up to the target voltage, the current limiting control having priority over an output voltage tracking control.

2. The power supply circuit according to claim 1, wherein the limited-current-value setting circuit is configured to continuously increase the limited value with an elapse in time during a rise of the output voltage.

3. The power supply circuit according to claim 2, wherein the power supply circuit is formed into a series regulator having circuitry in which a current supply path serving as the power transmission path is placed to connect both of the input terminal and the output terminal, the main transistor being placed in the current supply path.

4. A power supply circuit, comprising:

an electric switching element placed in a power transmission path connecting an input terminal to which an input voltage is applied and an output terminal through which an output voltage is applied to a load connected to the output terminal;

a voltage detecting circuit detecting the output voltage supplied through the output terminal;

a reference-voltage producing circuit producing a reference voltage in accordance with a target voltage;

a voltage control circuit controlling the switching element so that the detected output voltage tracks the reference voltage;

a current detecting circuit detecting an output current supplied through the output terminal to the load;

a limited-current-value setting circuit setting a limited value to the output current, the limited value increasing stepwise with a process in time during a rise of the output voltage up to the target voltage; and a current limiting circuit controlling the switching element to keep the detected output current at a current value less than or equal to the limited value during the rise of the output voltage up to the target voltage, the current limiting control having priority over the output voltage tracking control.

5. The power supply circuit according to claim 4, wherein the limited-current-value setting circuit is configured to stepwise increase the limited value by a predetermined amount at given intervals of time.

6. The power supply circuit according to claim 5, which is formed into a series regulator having circuitry in which a current supply path serving as the power transmission path is placed to connect both of the input terminal and the output terminal, the electric switching element being placed in the current supply path.

7. The power supply circuit according to claim 4, wherein the limited-current-value setting circuit is provided with a timer circuit counting a predetermined period of time and a limited-value increasing circuit increasing the limited value by the predetermined amount each time the timer circuit finishes counting the predetermined period of time.

8. The power supply circuit according to claim 4, which is formed into a series regulator having circuitry in which a current supply path serving as the power transmission path is placed to connect both of the input terminal and the output terminal, the electric switching element being placed in the current supply path.

9. The power supply circuit according to claim 4, wherein the electric switching element is a transistor element.

10. The power supply circuit according to claim 4, further comprising first and second smoothing circuits connected to the input and output terminals, respectively, and configured to smoothen the input and output voltages, respectively, wherein at least the voltage detecting circuit, the reference-voltage producing circuit, the voltage control circuit, the limited-current-value setting circuit, and the current limiting circuit are formed into an integrated circuit.

11. A power supply circuit, further comprising:

an electric switching element placed in a power transmission path connecting an input terminal to which an input voltage is applied and an output terminal through which an output voltage is applied to a load connected to the output terminal;

a voltage detecting circuit detecting the output voltage supplied through the output terminal;

a reference-voltage producing circuit producing a reference voltage in accordance with a target voltage;

a voltage control circuit controlling the switching element so that the detected output voltage tracks the reference voltage;

a current detecting circuit detecting an output current supplied through the output terminal to the load;

a limited-current-value setting circuit setting a limited value to the output current, wherein the limited value increases gradually with a progress in time during a rise of the output voltage up to the target voltage;

a current limiting circuit controlling the switching element to keep the detected output current at a current value less than or equal to the limited value during the rise of the output voltage up to the target voltage, the current limiting control having priority over the output voltage tracking control; and a delay control circuit outputting a rise start signal after a delay time from an application of the input voltage to the input terminal, wherein the limited-current-value setting circuit is configured to start setting the limited value in response to the outputted rise start signal.

12. The power supply circuit according to claim 11, wherein the delay time is set to a period of time during which a ringing component of the input voltage is reduced below a predetermined level.

13. The power supply circuit according to claim 12, wherein the delay control circuit is provided with a charge circuit operating with the input voltage applied and providing a charge voltage based on the input voltage and a comparison circuit drawing a comparison between the charge voltage and a given threshold and outputting the rise start signal when the charge voltage becomes equal to the given threshold.

14. The power supply circuit according to claim 12, wherein the delay control circuit is provided with an oscillation circuit outputting a reference clock signal and a timer circuit operating using the reference clock signal to output the rise start signal when the predetermined period of time elapses after the application of the input voltage to the input terminal.

15. The power supply circuit according to claim 12, further comprising a shutoff circuit configured to control the electric switching element in an off-state thereof until the rise start signal is outputted.

16. The power supply circuit according to claim 12, which is formed into a series regulator having circuitry in which a current supply path serving as the power transmission path is placed to connect both of the input terminal and the output terminal, the electric switching element being placed in the current supply path.

17. The power supply circuit according to claim 11, wherein the delay control circuit is provided with a comparison circuit drawing a comparison between the applied input voltage and a given threshold so as to output a comparison signal and a constant-level detecting circuit outputting the rise start signal on condition that the comparison signal is kept at the same level for a given interval of time.

18. The power supply circuit according to claim 11, further comprising a shutoff circuit configured to control the electric switching element in an off-state thereof until the rise start signal is outputted.

19. The power supply circuit according to claim 11, which is formed into a series regulator having circuitry in which a current supply path serving as the power transmission path is placed to connect both of the input terminal and the output terminal, the electric switching element being placed in the current supply path.

20. The power supply circuit according to claim 19, further comprising a shutoff circuit configured to control the electric switching element in an off-state thereof until the rise start signal is outputted.

21. A power supply circuit comprising:

an electric switching element placed in a power transmission path connecting an input terminal to which an input voltage is applied and an output terminal through which an output voltage is applied to a load connected to the output terminal;

a voltage detecting circuit detecting the output voltage supplied through the output terminal;

a voltage control circuit controlling the electric switching element so that the detected output voltage tracks a reference voltage to be targeted;

a current detecting circuit detecting an output current supplied through the output terminal to the load;

a limited-current-value setting circuit setting a limited value to the output current when a predetermined delay time has passed from an application of the input voltage to the input terminal, wherein the limited value increases gradually with a progress in time during a rise of the output voltage up to the target voltage; and a current limiting circuit controlling the switching element to keep the detected output current at a current value less than or equal to the limited value during the rise of the output voltage up to the target voltage, the current limiting control having priority over an output voltage tracking control.

22. The power supply circuit according to claim 21, wherein the delay time is set to a period of time during which a ringing component of the input voltage is reduced below a predetermined level.

23. The power supply circuit according to claim 22, wherein the delay control circuit is provided with a charge circuit operating with the input voltage applied and providing a charge voltage based on the input voltage and a comparison circuit drawing a comparison between the charge voltage and a given threshold and outputting the rise start signal when the charge voltage becomes equal to the given threshold.

24. The power supply circuit according to claim 21, wherein the electric switching element is a transistor element.

25. The power supply circuit according to claim 21, further comprising first and second smoothing circuits connected to the input and output terminals, respectively, and configured to smoothen the input and output voltages, respectively.

26. The power supply circuit according to claim 21, wherein at least the voltage detecting circuit, the voltage control circuit, the limited-current-value setting circuit, and the current limiting circuit are formed into an integrated circuit.

27. A power supply circuit, further comprising:

an electric switching element placed in a power transmission path connecting an input terminal to which an input voltage is applied and an output terminal through which an output voltage is applied to a load connected to the output terminal;

a voltage detecting circuit detecting the output voltage supplied through the output terminal;

a voltage control circuit controlling the electric switching element so that the detected output voltage tracks a reference voltage to be targeted;

a current detecting circuit detecting an output current supplied through the output terminal to the load;

a limited-current-value setting circuit setting a limited value to the output current when a predetermined delay time has passed from an application of the input voltage to the input terminal, wherein the limited value increases gradually with a process in time during a rise of the output voltage up to the target voltage;

a current limiting circuit controlling the switching element to keep the detected output current at a current value less than or equal to the limited value during the rise of the output voltage up to the target voltage, the current limiting control having priority over an output voltage tracking control; and a delay control circuit providing the limited-current-value setting circuit with the predetermined delay time.

* * * * *